US006079085A

United States Patent [19]

Chung

[11] Patent Number: 6,079,085

[45] Date of Patent: Jun. 27, 2000

[54] INVISIBLE ZIP FASTENER WITH DOUBLE OPEN END

[76] Inventor: Roger C. Y. Chung, 2F, No. 1, Alley 3, Lane 106, Lung-An Rd., Hsinchung City, Taipei Hsien, Taiwan

[21] Appl. No.: 09/352,410

[22] Filed: Jul. 14, 1999

[51] Int. Cl.[7] ..... A44B 19/00

[52] U.S. Cl. ..... 24/432; 24/433

[58] Field of Search ..... 24/642, 399, 400, 24/432, 433, 434, 429, 413, 405, 435, 436, 386, 388, 398, 387

[56] References Cited

U.S. PATENT DOCUMENTS

| | | | |
|---|---|---|---|
| 2,084,499 | 6/1937 | Newman | 24/432 |
| 2,251,137 | 7/1941 | Kay | 24/432 |
| 2,738,560 | 3/1956 | Hug | 24/432 X |
| 3,001,905 | 9/1961 | Morin | 24/432 X |
| 3,170,207 | 2/1965 | Morin | 24/433 |
| 3,175,268 | 3/1965 | Morin | 24/433 X |
| 3,324,522 | 6/1967 | Howell | 24/433 |
| 3,663,996 | 5/1972 | Heimberger et al. | 24/433 |
| 3,872,551 | 3/1975 | Moertel | 24/388 |
| 4,090,279 | 5/1978 | Wasko | 24/433 X |
| 4,104,767 | 8/1978 | Warren | 24/433 |
| 4,312,103 | 1/1982 | Akashi | 24/386 |
| 5,470,516 | 11/1995 | Fudaki | 24/432 X |
| 5,836,059 | 11/1998 | Chung | 24/432 |

*Primary Examiner*—James R. Brittain
*Assistant Examiner*—Robert J. Sandy
*Attorney, Agent, or Firm*—Bacon & Thomas, PLLC

[57] ABSTRACT

An invisible zip fastener having a male slide and a female slide pulled to close/open interlocking teeth at two zipper tapes, wherein a male end connector and a female end connector are respectively mounted on the zipper tapes at one end of the interlocking teeth and arranged facing each other, the male end connector and the female end connector each having a longitudinally extended clamping(groove respectively fixedly fastened to the zipper tapes, the male end connector having a coupling tongue facing the female end connector, and a protruding tooth, which is forced into engagement with one tooth at one end of the opposed zipper tape when the interlocking teeth at the zipper tapes are closed, the female end connector having a coupling groove, which receives the coupling tongue of the male end connector when the interlocking teeth at the zipper tapes are closed, and a projecting rear block, which stops the male slide in place when the male slide is pulled to one end to close the interlocking teeth.

2 Claims, 4 Drawing Sheets

A-A

INVISIBLE ZIP FASTENER WITH DOUBLE OPEN END

BACKGROUND OF THE INVENTION (a) Field of the Invention

The present invention relates to an invisible zip fastener, and more particularly to a double-open-end zip fastener, which comprises a male slide and a female slide moved to close the interlocking teeth at two zipper tapes thereof, a male end connector and a female end connector respectively provided at the zipper tapes at one end for engaging each other upon closing of the interlocking teeth.

(b) Description of the Prior Art

Regular invisible zip fasteners are commonly comprised of two zipper tapes, two interlocking spirals respectively fastened to a respective folded side edge at each of the zipper tapes by stitches, and a slide moved between the zipper tapes to close/separate the interlocking spirals. These invisible zip fasteners have only one open end. There are zip fasteners that provide two open ends. Similar designs are seen in U.S. Pat. Nos. 5,653,002; 5,469,605; 5,400,482; 5,297,319; 5,119,530. However, these double open end designs are of non-invisible zip fasteners.

SUMMARY OF THE INVENTION

The present invention has been accomplished to provide an invisible zip fastener, which has two open ends. According to the present invention, the invisible zip fastener comprises two zipper tapes, a male slide and a female slide pulled to close/open interlocking teeth at the zipper tapes, two top stops respectively provided at the zipper tapes at one end of the interlocking teeth, a male end connector and a female end connector respectively mounted on the zipper tapes at one end of the interlocking teeth remote from the top stops and arranged facing each other. The male end connector and the female end connector each have a longitudinally extended clamping groove respectively fixedly fastened to the zipper tapes. The male end connector comprises a coupling tongue facing the female end connector, and a protruding tooth, which is forced into engagement with one tooth at one end of the opposed zipper tape when the interlocking teeth at the zipper tapes are closed. The female end connector comprises a coupling groove, which receives the coupling tongue of the male end connector when the interlocking teeth at the zipper tapes are closed, and a projecting rear block, which stops the female slide in place when the female slide is pulled to one end to close the interlocking teeth.

DETAILED DESCRIPTION OF THE PREFERRED EMBODIMENT

Figure 1:
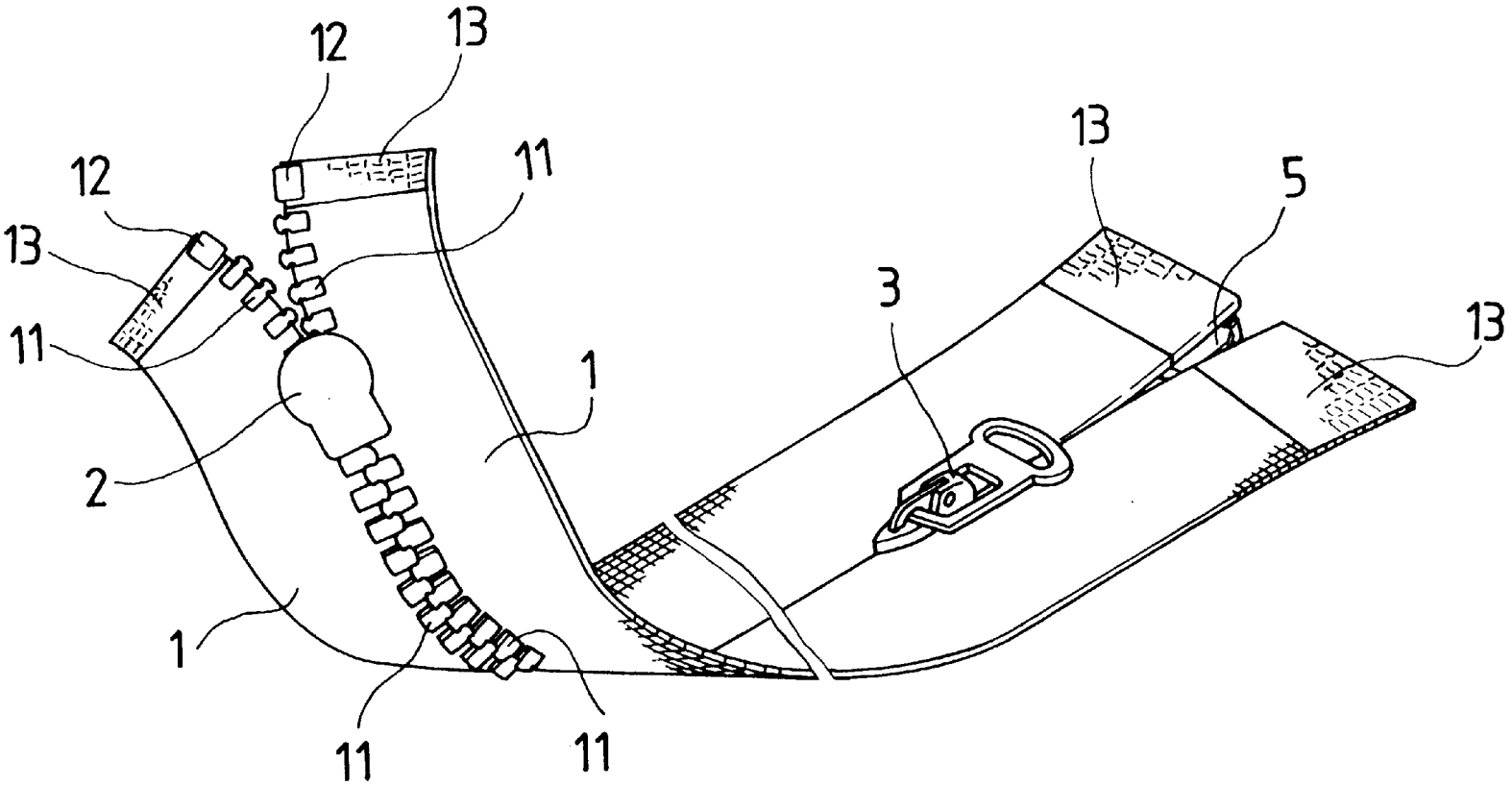
FIG. 1 a perspective view of an invisible zip fastener according to the present invention.
Figure 3:
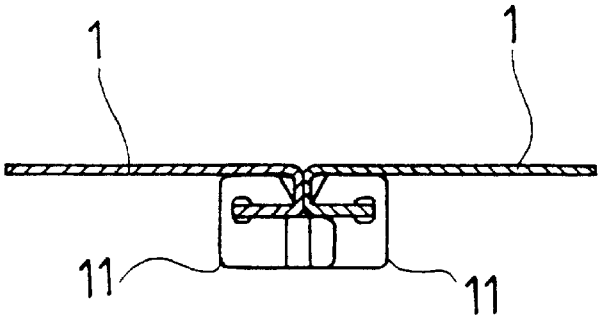
FIG. 3 is a sectional view taken along line A—A of FIG. 2.
Figure 2:
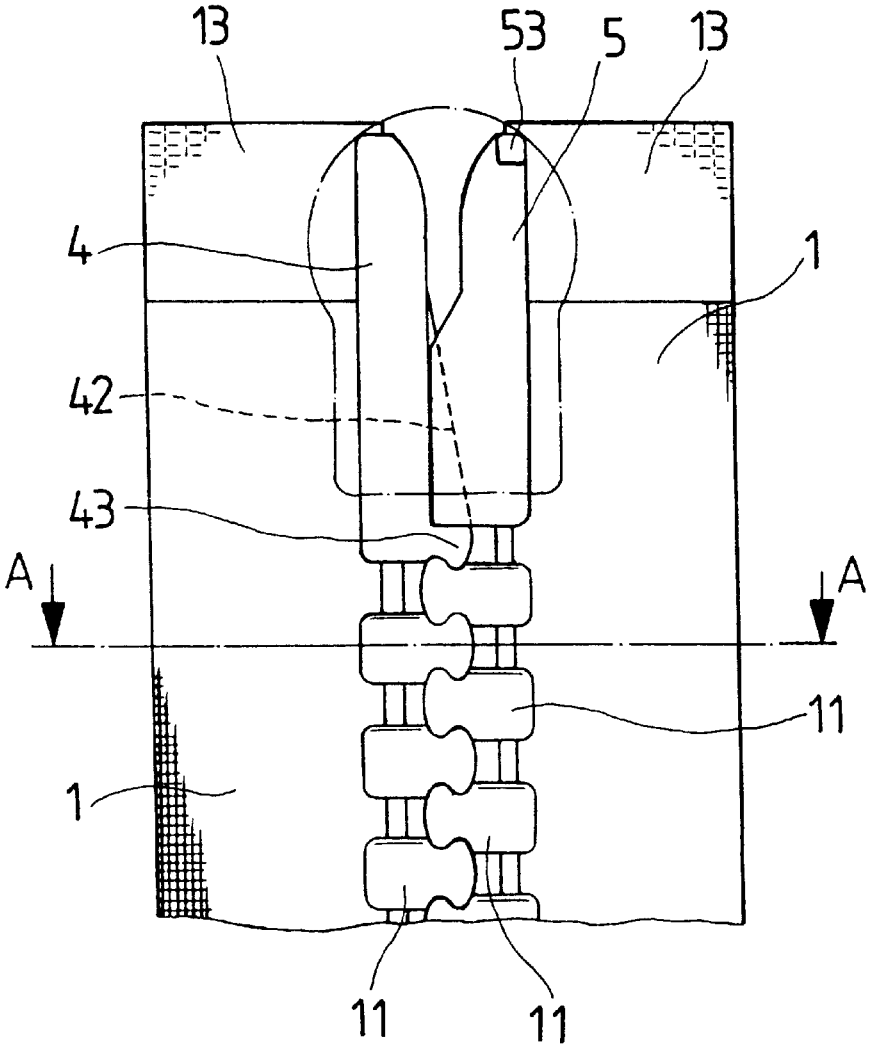
FIG. 2 is a plain view in an enlarged scale of a part of the present invention.
Figure 4:
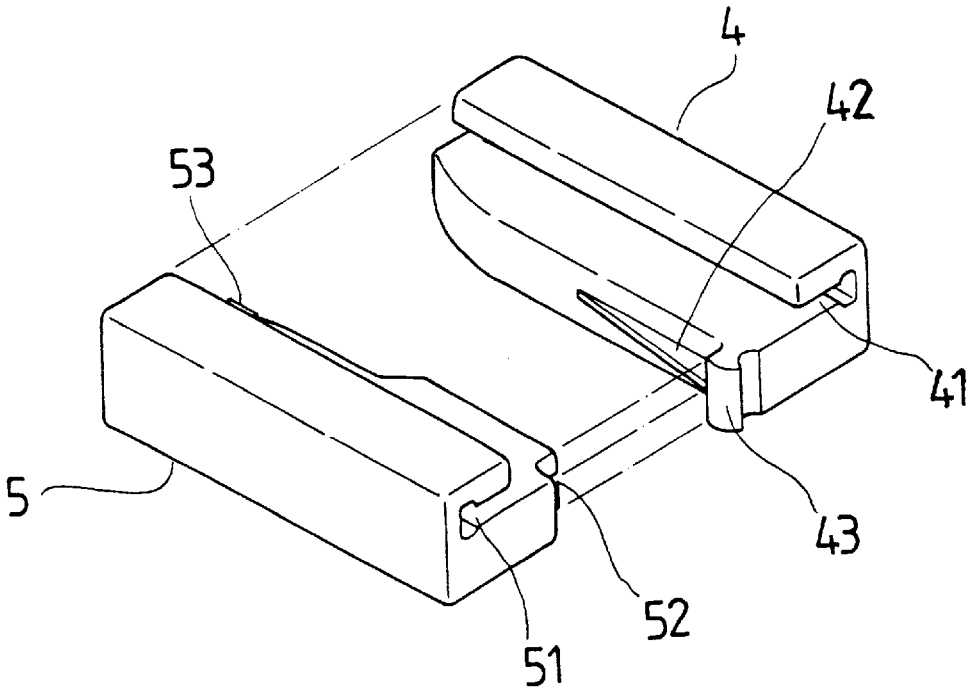
FIG. 4 is a perspective view in an enlarged scale of the male end connector and the female end connector according to the present invention.

Referring to FIGS. 1, 2 and 3, an invisible zip fastener is shown comprised of two zipper tapes 1, a male slide 2, a female slide 3, a male end connector 4, and a female end connector 5. The zipper tapes 1 each have one side edge mounted with a series of plastic teeth 11 and a top stop 12 at one end of each of the series of plastic teeth 11. The male end connector 4 and the female end connector 5 are respectively fastened to the zipper tapes 1 at one end of the respective series of plastic teeth 11 remote from the respective top stop 12. The male slide 2 and the female slide 3 are respectively connected to the plastic teeth 11 between the zipper tapes 1, and moved to close/separate the plastic teeth 11. When the male slide 2 is pulled to the end to close the plastic teeth 11, it is stopped at the top stop 12 at each of the zipper tapes 1. When the female slide 3 is pulled to the end to close the plastic teeth 11, it is stopped at a rear projecting block 53 at the female end connector 5.

Figure 5:
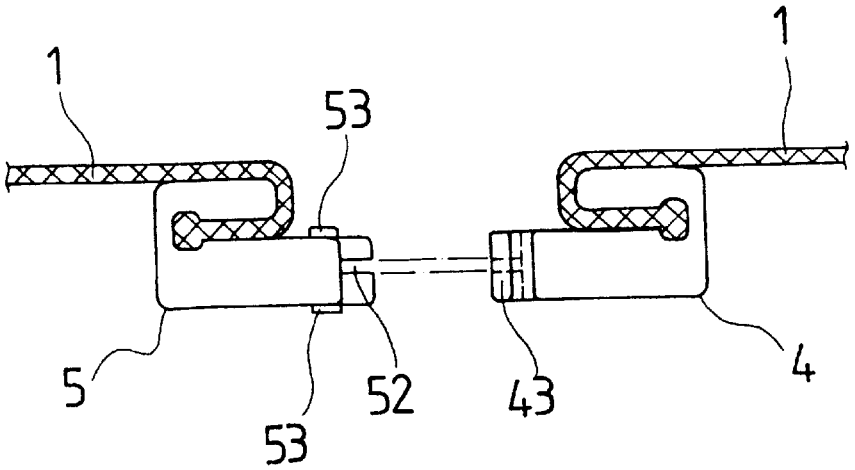
FIG. 5 is a sectional end view, showing the male end connector and the female end connector respectively fastened to the zipper tapes according to the present invention.
Figure 6:
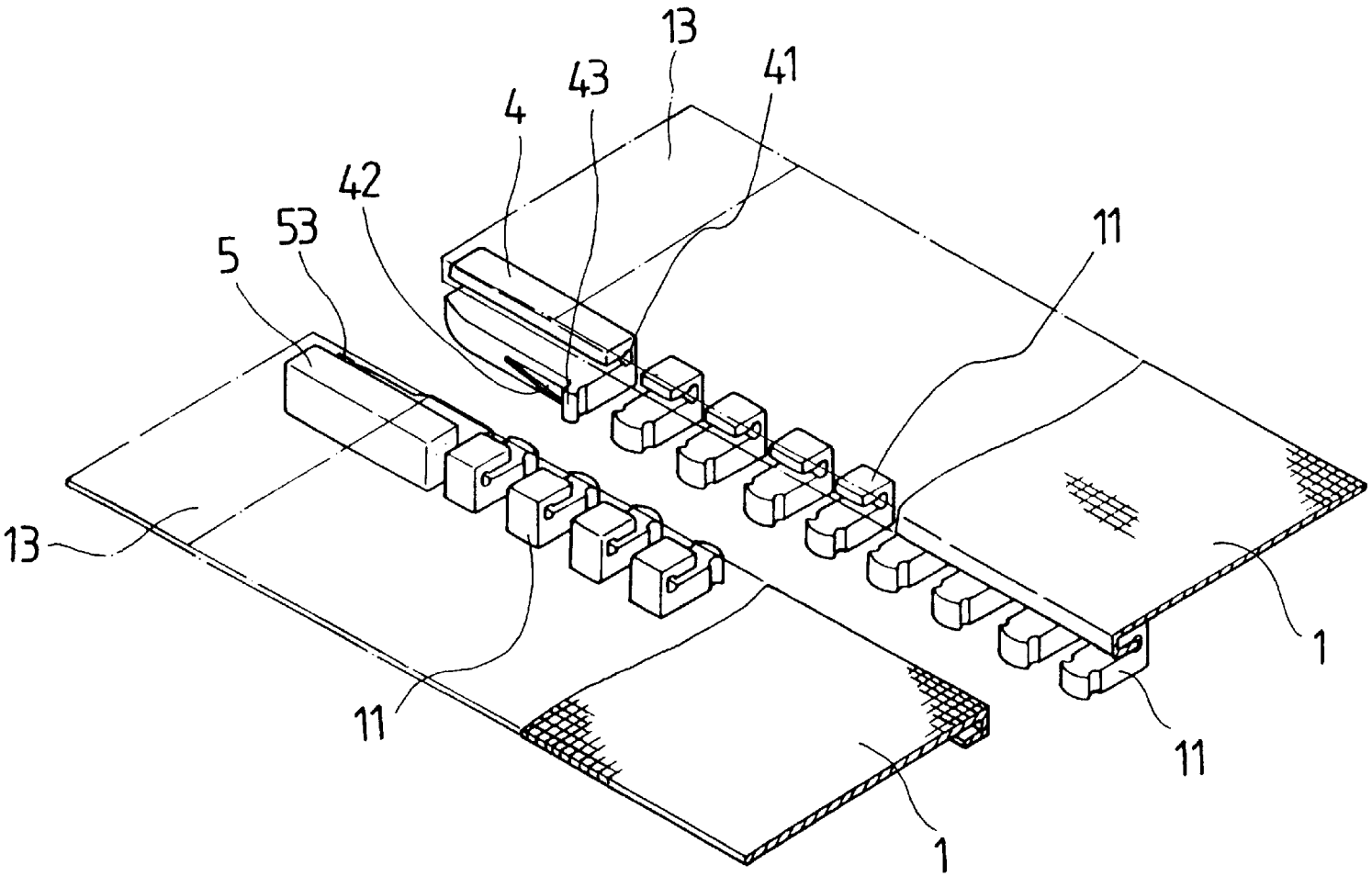
FIG. 6 is a perspective view in an enlarged scale of the present invention, showing a rigid plastic covering covered on each zipper tape at one end.

Referring to FIGS. from 4 through 6, the end connectors 4 and 5 have a substantially L-shaped cross section, each defining a longitudinally extended clamping groove 41 or 51 each of, which holds one zipper tape 1. The end connectors 4 and 5 can be directly injection-molded on the respective zipper tapes 1. Alternatively, the end connectors 4 and 5 can be respectively fastened to the zipper tapes 1 by casting or stamping. After the plain side edge (opposite to the side edge carrying the respective series of teeth 11) has been fixedly fastened to the clamping groove 41 or 51, the zipper tape 1 is turned backwards and covered over the end connector 4 or 5, and then secured in place by heating (see FIGS. 5 and 6). After the end connectors 4 and 5 and the zipper tapes 1 have been respectively fastened together, the end connectors 4 and 5 are disposed to face to each other. The male end connector 4 comprises a coupling tongue 42 facing the female end connector 5. The female end connector 5 comprises a coupling groove 52 for receiving the coupling tongue 42. The longitudinal length of the male end connector 4 is relatively longer than the female end connector 5. The male end connector 4 further comprises a protruding tooth 43 raised from the front end thereof at an inner side for engagement with one end tooth 11 at the opposite zipper tape 1. The aforesaid rear projecting block 53 is formed on the rear end of the female end connector 5. When the zip fastener is closed, the coupling tongue 42 at the male end connector 4 is engaged into the coupling groove 52 at the female end connector 5, and the female slide 3 is stopped at the rear projecting block 53 at the rear end of the female end connector 5.

The coupling tongue 42 is a triangle tongue raised from the vertical inner side wall of the male end connector 4, having a transverse width gradually increased in direction from the front side facing the teeth 11 at the respective zipper tape 1 toward the protruding tooth 43. The coupling groove 52 is a triangular groove fitting the triangular coupling tongue 42. Therefore, when the female slide 3 is pulled to close the teeth 11 at the zipper tapes 1, the coupling tongue 42 is smoothly forced into engagement with the coupling groove 52.

Referring to FIG. 6 again, a rigid plastic covering 13 is covered on one or both sides at each end of each zipper tape 1 to protect the fabric structure of each zipper tape 1. The rigid plastic covering 13 is welded to each zipper tape 1 by a ultrasonic heat sealing apparatus.

While only one embodiment of the present invention has been shown and described, it will be understood that various modifications and changes could be made thereunto without departing from the spirit and scope of the invention disclosed.

What the invention claimed is:

1. An invisible zip fastener comprising two zipper tapes, two rows of interlocking teeth respectively fastened to said zipper tapes, a male slide and a female slide moved to close/separate said interlocking teeth, two top stops respectively mounted on said zipper tapes at a first end of said two rows of interlocking teeth, wherein a male end connector and a female end connector are respectively mounted on said zipper tapes at a second end of said two rows of interlocking teeth and arranged facing each other, said male end connector and said female end connector each being of an L-shaped cross-section and comprising a longitudinally extended clamping groove respectively fixedly fastened to said zipper tapes, the zipper tapes each being folded over its respective male and female end connector and secured in place to position the male and female connectors facing each other, said male end connector comprising a coupling tongue facing said female end connector, and a protruding tooth which is forced into engagement with one tooth at one end of an opposed one of said zipper tapes when said two rows of interlocking teeth at said zipper tapes are closed, said female end connector comprising a coupling groove which receives the coupling tongue of said male end connector when said two rows of interlocking teeth at said zipper tapes are closed and a projecting rear block which stops said female slide in place when said female slide is pulled to the second end to close said two rows of interlocking teeth.

2. The invisible zip fastener of claim 1 wherein the coupling tongue of said male end connector is a triangle tongue raised from a vertical inner side wall of said male end connector, said triangle tongue having a transverse width gradually increasing in direction from a front side near said two rows of interlocking teeth toward the protruding tooth at said male end connector, and the coupling groove at said female end connector is a triangular groove engageable by the triangular coupling tongue at said male end connector.

* * * * *